United States Patent [19]

Bauer

[11] 4,397,577

[45] Aug. 9, 1983

[54] SNAP-ACTION ONE-PIECE CLAMPING DEVICE

[76] Inventor: Peter Bauer, 13921 Esworthy Rd., Germantown, Md. 20767

[21] Appl. No.: 227,718

[22] Filed: Jan. 23, 1981

[51] Int. Cl.[3] ..... B42F 3/00

[52] U.S. Cl. ..... 402/19; 24/67 R; 24/255 SL; 24/257

[58] Field of Search ..... 24/67 PR, 67.9, 67.5, 24/255 SL, 257; 402/19, 26; 281/42, 45

[56] References Cited

U.S. PATENT DOCUMENTS

| | | | |
|---|---|---|---|
| 756,535 | 4/1904 | Senderling | 24/67.9 X |
| 1,355,287 | 10/1920 | Treiber | 24/67.5 X |
| 1,467,781 | 9/1923 | Dawson | 411/338 |
| 1,988,345 | 1/1935 | Vaughn | 411/516 X |
| 2,368,544 | 1/1945 | Hogan | 411/514 |
| 4,174,910 | 11/1979 | McSherry et al. | 402/19 |

FOREIGN PATENT DOCUMENTS

| | | | |
|---|---|---|---|
| 80280 | 9/1894 | Fed. Rep. of Germany | 402/19 |

*Primary Examiner*—Paul A. Bell

*Attorney, Agent, or Firm*—Griffin, Branigan & Butler

[57] ABSTRACT

A snap-action one-piece clamping device, made of spring steel, plastic, or the like, includes an endless member and a tongue. The endless member is a frusto-conical or frusto-spherical band having inner and outer rims of generally oval or rectangular configuration. The tongue projects transversely from either the inner or outer rim, depending upon the embodiment. The endless member has two stable positions on opposite sides of a reference plane defined by its outer rim and can be snapped to either position from the other by finger pressure applied toward the reference plane proximate the longitudinal mid-point in the endless member. The tongue is positionally slaved to the endless member and likewise has two stable positions. In one embodiment the tongue projects from the inner rim and clamps sheet material or a tube against the inner rim. In another embodiment the tongue projects from the outer rim and extends along a pen or the like to clamp a pocket against the pen.

9 Claims, 16 Drawing Figures

SNAP-ACTION ONE-PIECE CLAMPING DEVICE

TECHNICAL FIELD

The present invention relates to clamping and, more particularly, to an improved technique for clamping sheet material and tubes using a positionally bi-stable device.

BACKGROUND OF THE INVENTION

The prior art is replete with devices which are generally characterized as paper clips, some of which may also serve as indexing tabs. The primary function of such devices is to provide an adequate clamping action normal to the clamped sheets without damaging the sheets or the clamping device itself. Importantly, the clamping device must be capable of simple and inexpensive fabrication.

Most prior art paper clip devices rely on the resiliency of the device to urge two separable members together. Such devices, by and large, are unsatisfactory for clamping more than an insignificant number of sheets together; those which do effectively clamp large stacks of sheets together are complex and costly to fabricate.

After duly considering this problem I have concluded that paper clips should properly employ a snap action whereby the clip is switchable between two stable positions. The only bi-stable paper clip I have been able to find in the prior art is disclosed in German Pat. No. 80280 (Schwegler, 1894). That paper clip includes a flat sheet and a dimpled top sheet, both made of metal and joined along one edge. In the open position, the dimple is oriented convexly toward the flat sheet so that the free end of the top sheet curves away from the flat sheet. Papers can be inserted between the sheets so that, when the top sheet is urged by finger pressure toward the flat sheet, the dimple snaps outwardly to force the free bent-over and serrated edge of the top sheet to clamp the papers against the flat sheet surface. The clip can be opened by pressing the now outwardly convex dimple inward. While the top sheet of this clp is, in fact, bi-stable, it has several disadvantages. Firstly, the clamping action is achieved only among the bent-over edge of the top sheet which makes a linear contact with the engaged stack. This extremely small contact area is not sufficient for clamping stacks made up of a significant number of sheets. Moreover, if the bent-over edge of the top sheet of the clamp is serrated, as disclosed, it is likely to multilate the top document sheet. In any case, the clamping force of the Schwegler paper clip does not prevent dislodging of the clamped sheets in response to forces exerted on the sheets along their planes. Another disadvantage of the Schwegler clamp resides in the fact that the stresses set up in the top sheet of the clamp during deformation of the dimple result in only a small number of switching operations before the top sheet of the clamp ruptures, particularly if stacks of any significant number of documents are clamped.

SUMMARY OF THE INVENTION

It is therefore an object of the present invention to provide a method and apparatus for adequately clamping large and small stacks of sheet material without mutilating the sheets or damaging the apparatus and yet which is simple and inexpensive to fabricate. More specifically, it is an object of the present invention to provide an effective paper clip which has the aforesaid advantages and features and which has two stable positions rather than relying only on resilience between two parts to effect a clamping force. It is still another object of the present invention to provide an effective clamping action which is useful in such devices as paper clips, pocket clips, index tabs, binder clips, and tube clamps.

In accordance with the present invention I employ an endless (i.e. continuous) frusto-conical or frusto-spherical member, having inner and outer rims of generally oval or rectangular configuration, which is made of spring steel or similar material and which has two stable positions on either side of the imaginary reference plane defined by its outer rim. (A similar device, of circular periphery, has been used in the past as an electrical switch for thermostats, or the like, as described in U.S. Pat. No. 1,988,345 to Vaughn). In the preferred embodiment the inner rim of the endless member has a tongue projecting generally inward and toward the same side of the reference plane as the current position of the endless member. In one stable position, the endless member forms a first small defined angle with respect to the reference plane. In this position, a stack of documents may be inserted in the angular space between the tongue and the endless member. Appropriately applied finger pressure proximate the longitudinal mid-point of the endless member and tongue, in a direction toward the reference plane, causes the device to snap to its second stable position in which the endless member subtends a second small defined angle with the reference plane but on the opposite of the plane from the first angle. The first and second angles, corresponding to the two stable positions, may be equal or not. During switching from one stable position to the other, the tongue passes through a second imaginary plane defined by the inner rim of the endless member. The stack of papers disposed between the tongue and endless member is thereby crimped slightly through the endless member opening and, in the second stable position, is squeezed firmly between the tongue and endless member. The documents are thus firmly held together, without being multilated, over the relatively large area defined within the inner rim of the endless member. The clip can be removed by exerting a similar finger pressure in the opposite direction.

In a preferred paper clip embodiment the transverse spacing between the tongue and the inner rim of the endless member is enlarged at the root of the tongue (i.e., at the location where the tongue is secured to the endless member) in order to facilitate insertion of a large stack of documents into the clip all the way to the tongue root. The tongue may also be bent to accommodate a large stack and need not pass through the plane of the inner rim when being switched.

In another embodiment of the invention I employ the bi-stable clamping action to clamp a flow tube. In this embodiment the tongue and/or inner rim are indexed transversely of the tongue at various distances from the root. Depending upon the index position in which the tube is placed, the clamping force, and hence the flow blockage, differs when the device is switched.

In still another embodiment the tongue may project outwardly from the outer rim of the endless member. In this embodiment the clamp is secured to a pen, or the like, and the tongue extends longitudinally along the pen. Switching positions of the endless member permits the tongue to serve as a pocket clip whereby the tongue selectively engages and releases the pocket material between it and the pen.

BRIEF DESCRIPTION OF THE DRAWINGS

The above and still further objects, features and advantages of the present invention will become apparent upon consideration of the following detailed description of specific embodiments thereof, especially when taken in conjunction with the accompanying drawing, wherein:

FIG. 15 is a plan view of a blank which can be used, in accordance with the present invention as a pocket clip for a pen, or the like.

DESCRIPTION OF THE PREFERRED EMBODIMENTS

Figure 1:
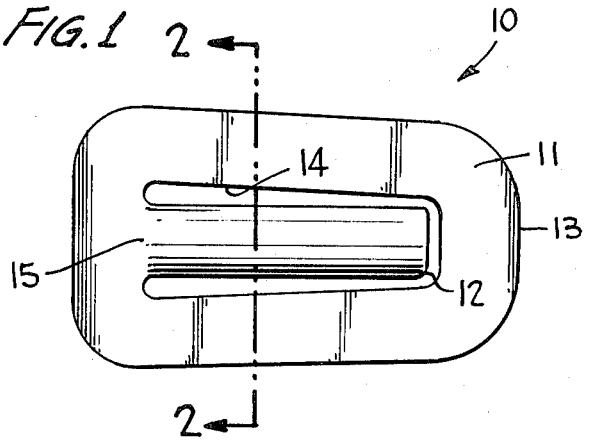
FIG. 1 is a top view in plan of a bi-stable paper claip constructed in accordance with the present invention.
Figure 2:
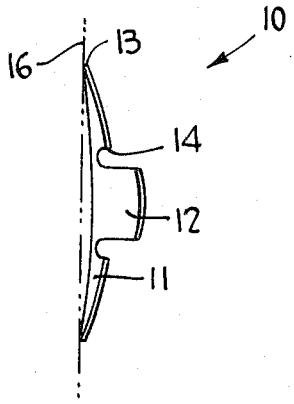
FIG. 2 is a view in section taken along lines 2—2 of FIG. 1.
Figure 3:
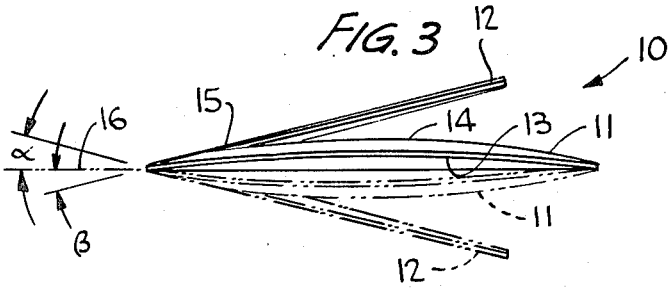
FIG. 3 is a side view of the paper clip of FIG. 1 diagrammatically illustrating both stable states of the clip.
Figure 4:
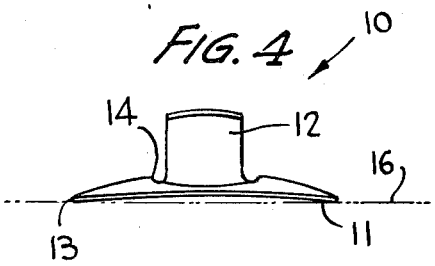
FIG. 4 is an end view of the clip of FIG. 1.

Referring more specifically to FIGS. 1 through 4, a paper clip 10 is made of one piece including an endless member 11 and tongue 12. Clip 10 can be made from a variety of thin spring-like materials such as spring steel, spring brass, plastic, rubber, etc., which are treated to function in the manner described herein. Endless member 11 is a continuous frusto-conical or frusto-spherical band with an outer rim 13 and inner rim 14 of generally oval or rectangular configuration. Although illustrated as having a uniform width (i.e. the dimension between rims 13 and 14) throughout its length, endless member 11 may have a varying width.

Endless member 11 subtends a small angle $\alpha$ with respect to an imaginary reference plane 16 defined by its outer rim 13. This angle is nominally within the range of five to fifteen degrees. If sufficient bending force is exerted on endless member 11 normal to plane 16, the endless member snaps to a second stable position (illustrated by dotted lines in FIG. 3) on the opposite side of plane 16. The angle $\beta$ subtended by endless member 11 in its second position may be the same as angle $\alpha$ subtended in the first stable condition.

Tongue 12 projects above the area enclosed by inner rim 14, at an angle relative to plane 16 which may or may not be $\alpha$, from a portion of the inner rim 14 extending along a minor or small dimension of that rim. The portion of rim 14 from which tongue 12 projects is designated by the numeral 15 and is characterized hereinbelow as the "root" 15 of the tongue. The projection of tongue 12 in plane 16 extends generally along the major or long dimension of endless member 11, encompassing an area just slightly smaller than that enclosed by inner rim 14. When endless member 11 is forced to its second position, tongue 12 moves therewith, to the dotted line position of FIG. 3, so that it passes through reference plane 16. In so moving between the two stable positions, tongue 12 also passes through the enclosed area defined by inner rim 14.

In the preferred embodiment of my invention, and as best illustrated in FIG. 1, the clearance between tongue 12 and inner rim 14 is greater near the tongue root 15. This feature, as will be seen hereinbelow, permits clip 10 to readily engage and clamp together a relatively thick stack of documents.

Figure 5:
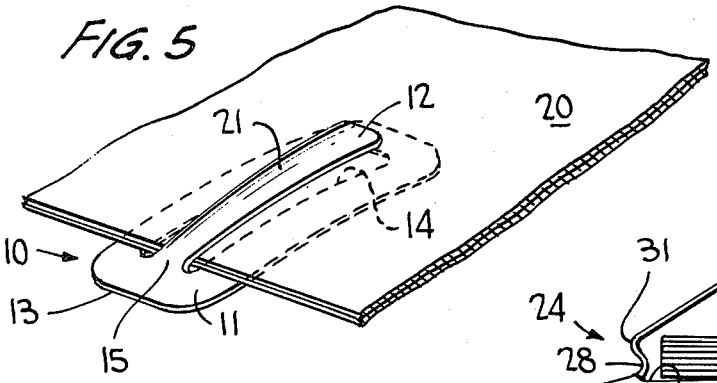
FIG. 5 is a view in perspective illustrating the paper clip of the present invention in its open position with a stack of papers inserted.
Figure 6:
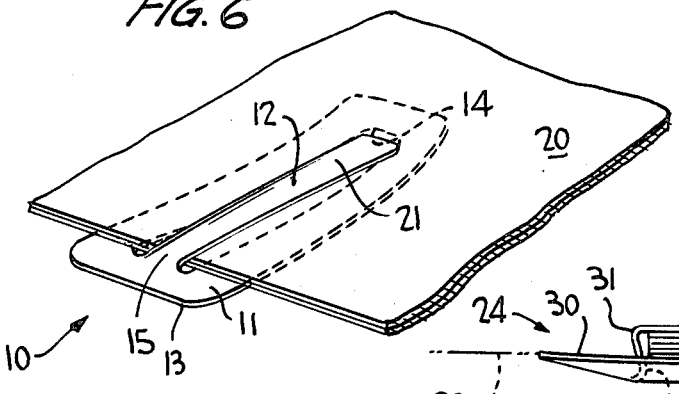
FIG. 6 is a view in perspective illustrating the paper clip of the present invention in its closed position wherein the stack of papers is clamped.

Referring to FIG. 5, paper clip 10 is shown in one stable position with one edge of a stack 20 of documents inserted as far as possible into the angular space between tongue 12 and endless member 11. The enlarged clearance between tongue 12 and inner rim 14 proximate root 15 facilitates full insertion of the stack 20 into the angular space. In order to clamp the documents in stack 20 together, bending force is exerted, by the user's fingers, on the tongue 12 and endless member 11 to force the clip 10 to its other stable position. Most efficiently, the pressure is applied mid-way between the ends of the length dimension of the clip and in a downward direction as viewed in FIG. 5. This pressure forces clip 10 to assume its other stable state or position, as illustrated in FIG. 6, whereby tongue 12 passes through the area enclosed by inner rim 14 to slightly crimp stack 20 and firmly engage it between tongue 12 and endless member 11.

By way of example only, and not to be construed as limiting the scope of my invention, the dimensions for a clip 10 which I have made and successfully used are as follows: length of overall clip, $1\frac{1}{8}$ inch; width of overall clip, $\frac{5}{8}$ inch; width of endless member 11 between rims 13 and 14, 3/16 inch; width of tongue 12, 0.220 inch; length of tongue 12 from root 15 to tip, 0.713 inch; thickness or depth of endless member 11 and tongue 12, 0.18 inch; widest spacing between tongue 12 and rim 14 (at root 15), 1/16 inch; narrowest spacing between tongue 12 and rim 14 (proximate distal end), 1/64 inch.

It should be noted that the elongated configuration (i.e. generally oval or rectangular) of clip 10 provides a mechanical advantage which facilitates switching between stable states or positions. In this respect, the longer the clip, the easier it is to operate.

Further notice should be taken of the fact that tongue 12 may be crimped at 21 (FIGS. 5, 6), if desired, for purposes of longitudinally stiffening the tongue against bending. Crimping, in this respect, means a longitudinally-extending bend in the tongue or a portion thereof.

The clip as described is quite suitable for advertising and promotional use in that the name of a sponsor or advertiser can readily be imprinted or embossed on the tongue and/or the endless member.

The description of the clip as set forth above states that angles $\alpha$ and $\beta$ can be the same or different. This is merely a question of symmetrical versus assymmetrical deflection of endless member 11 with respect to plane 16. An advantage of an assymmetrical device resides in the fact that the stable position in which the smaller angle is subtended may be used as the open position for a small stack of documents whereas the larger angle stable position may be more readily used as the open position for a large stack of documents. This bi-modal operation for clamping together different size stacks is quite unique.

Figure 7:
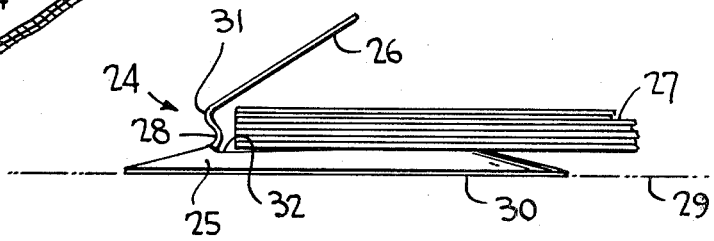
FIG. 7 is a side view of another bi-stable paper clip embodiment of the present invention adapted for use with large documents, the clip being shown in its open position.
Figure 8:
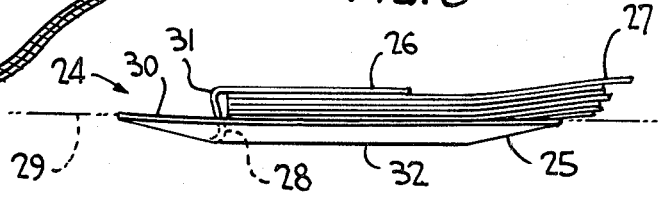
FIG. 8 is a view similar to that of FIG. 7 but showing the clip in its closed position.

Another embodiment of the present invention is illustrated in FIGS. 7 and 8 to which specific reference is now made. A paper clip 24 is expressly adapted for specialized use with a thick stack 27 of documents or other sheet material. Endless member 25 is similar in all respects to endless member 11 of the embodiment of FIGS. 1–4. Tongue 26 extends from the inner rim 32 of member 25 but, unlike tongue 12 of FIGS. 1–4, is provided with a sharp bend 28 at its root in a direction away from the reference plane 29 defined by outer rim 30. Tongue 26 includes a second, substantially right-angle bend 31 a short distance from its root. The tongue segment between bends 28 and 31, as clearly illustrated in FIGS. 7 and 8, permits a relatively thick stack of sheets to be accommodated and clamped between tongue 26 and endless member 25.

It should be noted that with the bend tongue configuration of FIGS. 7 and 8, the tongue 26 does not pass through the plane of the inner rim of endless member 25. Clamping, however, is nonetheless efficient when the clip is moved to its closed position illustrated in FIG. 8.

Figure 9:
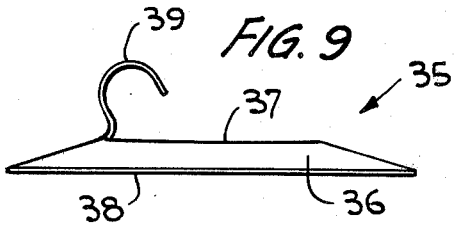
FIG. 9 is a side view of another embodiment of the present invention which is useful as a binder clip, the clip being shown in its open position.
Figure 10:
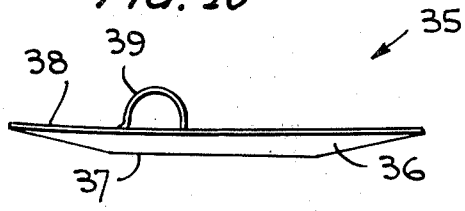
FIG. 10 is a view similar to that of FIG. 9 but showing the clip in its closed position.

The clip embodiment 35 illustrated in FIGS. 9 and 10 is adapted primarily as a binder clip for fastening together documents provided with loose-leaf holes or other apertures near an edge of the documents. In this embodiment, endless member 36 is substantially the same as member 11 of the embodiment in FIGS. 1 to 4 and includes an inner rim 37 and outer rim 38. The tongue 39, however, is in the general form of a flat member bent in the shape of a hook which is bent away from member 36 at its root and curves substantially continuously so that its distal end is directed back toward member 36. In the open position of binder clip 35, seen in FIG. 9, the distal end of the hook-like tongue 39 is spaced considerably from endless member 36 to permit insertion of documents between that distal end and inner rim 37. In this position, tongue 39 and endless member 36 are positioned on the same side of the reference plane defined by outer rim 38. When binder clip 35 is snapped to its closed position, as illustrated in FIG. 10, inner rim 37 passes through the reference plane of outer rim 38, and the distal end of tongue 39 moves closer to that reference plane. Preferably, the distal end of tongue 39 passes through the reference plane so as to prevent there being any gap between the distal end of the tongue and the endless member.

Figure 11:
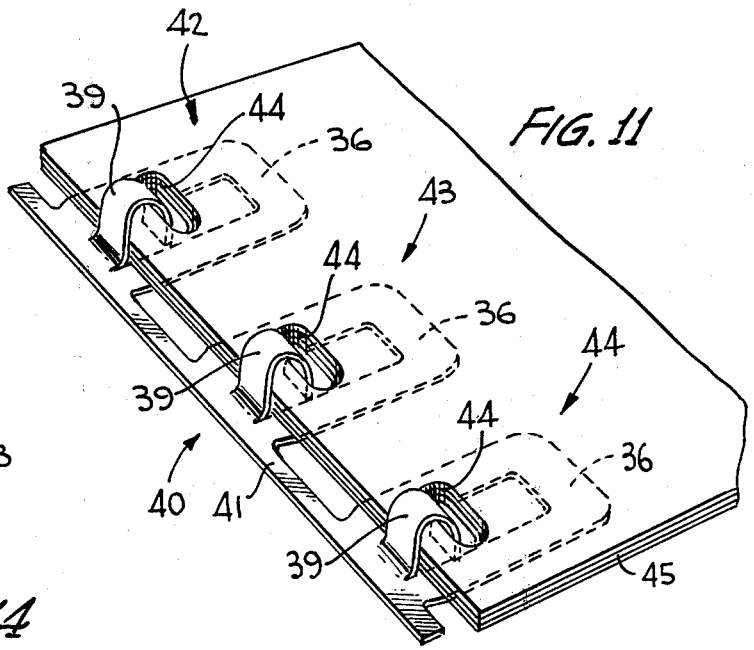
FIG. 11 is a view in perspective showing a binder clip employing plural elements according to the present invention.

A one-piece, three-element binder clip 40 is illustrated in FIG. 11. An elongated strip 41 includes three clips, 42, 43, 44 integral therewith and projecting from spaced locations along a common edge thereof. Each of clips 42, 43, 44 have an endless member 36 of the same general type as illustrated in FIGS. 9 and 10 and having a short side in common with strip 41. Each clip 42, 43 and 44 likewise includes a tongue 39 of the type illustrated in FIGS. 9 and 10 and having its root located at the side of endless member 36 which is in common with the strip 41. Tongues 39 are aligned with one another and spaced to match the spacing in binder holes 44 defined through documents 45. The binder holes 44 may be loose-leaf holes or other holes disposed along an edge of the documents to permit binding. Each of the clips 42, 43, 44 is independently operable between a closed position (as illustrated in FIG. 11) and an open position by appropriate finger pressure applied proximate the longitudinal mid-point of endless member 36. The effect of tongue 39 is the same as described in relations to FIGS. 9 and 10.

Figure 12:
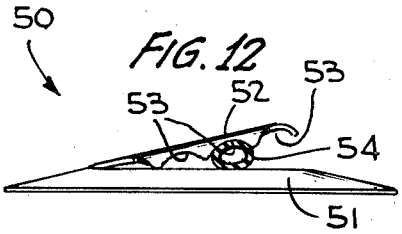
FIG. 12 is a side view of another embodiment of the present invention used as a tube clamp, the clamp being shown in its open position.
Figure 13:
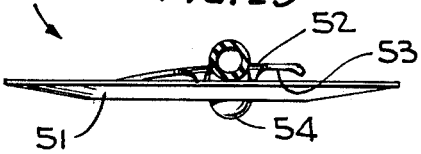
FIG. 13 is a view similar to that of FIG. 12 with the clamp shown in its closed position.
Figure 14:
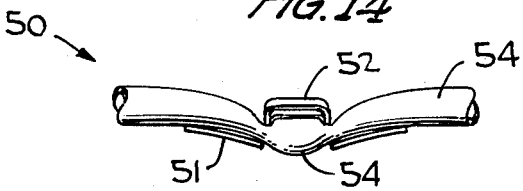
FIG. 14 is an end view in partial section of the clamp of FIG. 13.

The clamping action defined herein for sheet-like material is also suitable for clamping flow tubes. It will be readily appreciated that a flexible flow tube, disposed between the tongue and endless member transversely of the tongue, can be pinched off by snapping the clamp to its closed position. A clamp 50 for providing this function is illustrated in FIGS. 12, 13 and 14, with the clamp being illustrated open in FIG. 12 and closed in FIGS. 13 and 14. Tube clamp 50 includes an endless member 51 similar to endless member of FIGS. 1–4. A tongue 52 is similar to tongue 12 but includes a pair of depending edges which extend longitudinally of the tongue and which are provided with a series of aligned arcuate recesses 53 in side-by-side relation. Arcuate recesses 53 are intended to very generally match the curvature of a portion of a flow tube 54 which is to be selectively pinched off by clamp 50.

In the open positin of clamp 50, illustrated in FIG. 12, tube 54 is placed between tongue 52 and endless member 51 in one of tongue recesses 53. In this position, the resilience of the tongue causes it to slightly squeeze, but not pinch off, the flow in tube 54. The particular recess 53 in which the tube 54 is positioned will determine how much pressure is applied to squeeze the tube in this open position, it being clear that the greatest flow restriction occurs when the tube 54 is closest to the root of the tongue. When the clamp is closed, as illustrated in FIGS. 13 and 14, the tongue acts in conjunction with the inner rim of the endless member 51 to pinch off flow in tube 54 at two locations on opposite edges of the tongue. Clamp 50 thus permits the user to select a variety of flow restrictions in its open position and a complete flow pinch-off condition in its closed position.

Figure 15:
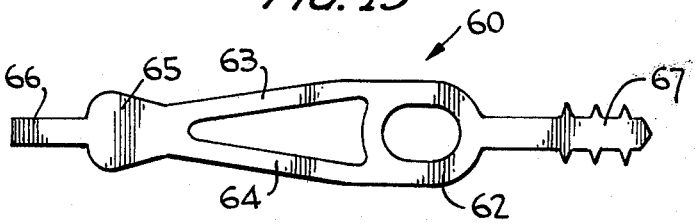

The applications for the clamp which have been described above all relate to a tongue which projects inwardly of the endless member, from the inner rim, so as to provide the desired clamping action between the tongue and the bi-stable endless member. It is also possible to effect a clamping action with a tongue projecting outwardly from the outer rim; however, while such a clamp uses the positional bi-stability of the endless member, the endless member does not participate in the clamping action. A one-piece clamp of this type is illustrated in the form of a pocket clip 60 for a pen 61, or the like, in FIGS. 15 and 16. Clip 60 includes an endless member 62 of the same type as member 11 of FIGS. 1–4. The tongue is in the form of two strips 63,64 which corresponds to extensions of the longer sides of endless member 62, which strips converge to a solid region 65. The distal end 66 of the solid region 65 is beaded or thickened by bending the edges over, to provide an enlarged contact region for clamping a pocket between the tongue and pen 61. The opposite edge of endless member 62 is provided with an integral extension 67 which is adapted to be secured to the body of pen 61. In the illustrated embodiment extension 67 is barbed and is bent 180°, the barbs being beng over to engage the pen 61.

Figure 16:
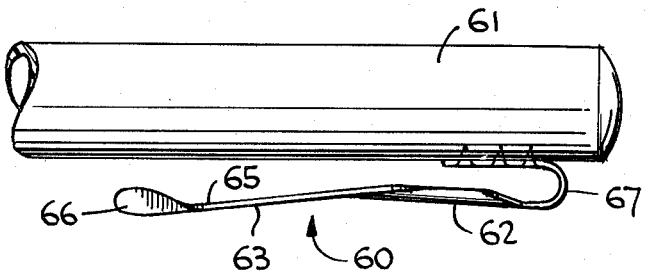
FIG. 16 is a side view of a pen and the blank of FIG. 15 adapted to function as a pocket clip.

In the open position of pocket clip 60, as illustrated in FIG. 16, the bead 66 at the end of the tongue is spaced from pen 61. In this position, the inner rim of the endless member 62 is closer to the pen than the outer rim. Finger pressure on the tongue or endless member 62 toward the pen 61 causes the endless member to snap to its closed position whereby its outer rim is closer to pen 61 than its inner rim. In this position the bead 66 of the tongue abuts pen 61 to clamp a pocket strip between it and the pen.

It should be noted that the outwardly projecting tongue need not have two elements 63 and 64 but could function in the manner described if it were only a single strip, preferably projecting from the middle of the short dimension of endless member 62. Likewise, in the embodiments of FIGS. 1–14 with inwardly projecting tongues, plural tongue elements may be employed.

While I have described and illustrated various specific embodiments of my invention, it will be clear that variations of the details of construction which are specifically illustrated and described may be resorted to without departing from the true spirit and scope of the invention as defined in the appended claims.

I claim:

1. A positionally bi-stable clamping device formed from a single member comprising a thin endless member having outer and inner rims, said outer rim defining a reference plane, said inner rim enclosing a prescribed open area, said rims each having a length dimension and a width dimension wherein said length dimension is greater than said width dimension, said endless member having a first stable position wherein it subtends a first angle with said reference plane on a first side of said reference plane and a second stable position wherein it subtends a second angle with said reference plane on a second side of said reference plane, said single member further comprising a tongue in the form of an elongated member projecting in said length dimension inward of said endless member from said inner rim in a first orientation with respect to said reference plane when said endless member is in said first position and in a second orientation with respect to said reference plane when said endless member is in said second position, whereby an object inserted between said tongue and said outer member in said first stable position can be clamped between said tongue and said outer member in said second stable position; said tongue including a root portion where it projects from said inner rim, and a distal end remote from said root portion, said tongue being bent away from said reference plane proximate said root portion and further bent toward said reference plane between said root portion and said distal end.

2. The device according to claim 1, wherein said first and second angles are equal.

3. The device according to claim 1, wherein said first and second angles are unequal.

4. The device according to claim 1, wherein said tongue is slightly smaller than the prescribed area enclosed by said inner rim, and wherein said tongue must pass through said prescribed area when moving between said first and second orientation.

5. The device according to claim 1, wherein said tongue is in the form of a hook adapted to project through an aperture in an object being clamped.

6. The device according to claim 5, wherein said hook is continuously bent through an angle of at least 180° along its length.

7. The device according to claims 1 or 5, further comprising a plurality of said clamping devices joined as part of an integral member, each of said devices being independently switchable between its stable positions.

8. The device according to claim 7, wherein said integral member includes an elongated strip having a longitudinal edge from which said plurality of devices extend at spaced locations.

9. The device according to claim 1 adapted for clamping a flow tube, said device further comprising a plurality of arcuate recesses defined in one side of said tongue, said arcuate recesses being curved to receive a portion of the periphery of said flow tube therein, and wherein said tongue subtends an acute angle with said inner rim in said first orientation and compresses said tube to a different degree depending upon which of said recesses receives said tube, and wherein said tongue moves toward said prescribed area in switching from said first to said second orientation to completely restrict flow through said tube.

* * * * *